US008966691B2

(12) United States Patent
Richards

(10) Patent No.: US 8,966,691 B2
(45) Date of Patent: Mar. 3, 2015

(54) FOLDING INTERCHANGEABLE IMPLEMENT APPARATUS

(71) Applicant: Todd Richards, Bristol, ME (US)

(72) Inventor: Todd Richards, Bristol, ME (US)

( * ) Notice: Subject to any disclaimer, the term of this patent is extended or adjusted under 35 U.S.C. 154(b) by 222 days.

(21) Appl. No.: 13/793,716

(22) Filed: Mar. 11, 2013

(65) Prior Publication Data

US 2013/0305460 A1 Nov. 21, 2013

Related U.S. Application Data

(60) Provisional application No. 61/647,668, filed on May 16, 2012.

(51) Int. Cl.
*B25F 1/02* (2006.01)
*B25F 1/04* (2006.01)

(52) U.S. Cl.
CPC .... *B25F 1/02* (2013.01); *B25F 1/04* (2013.01)
USPC ..... 7/168; 7/118

(58) Field of Classification Search
USPC ..... 7/118, 125, 128, 158, 168
See application file for complete search history.

(56) References Cited

U.S. PATENT DOCUMENTS

| | | | | |
|---|---|---|---|---|
| 153,119 | A * | 7/1874 | Schofield | 7/118 |
| 7,926,136 | B2 | 4/2011 | Yale et al. | |
| 2008/0086822 | A1 | 4/2008 | Elsener | |

* cited by examiner

*Primary Examiner* — David B Thomas
(74) *Attorney, Agent, or Firm* — Anthony D. Pellegrini

(57) ABSTRACT

A compact, folding tool permitting the exchange of implement sets, including one or more quick release mechanisms that are easily removed from a handle to release interchangeable implements; the tool further accommodating implement sets including different types and quantities of implements which are inhibited from rotating by an adjustable clamping force produced by the quick release mechanisms and optionally including over travel stops to obstruct implement rotation, or may rely solely on the clamping force provided by the quick release mechanisms to stabilize implements for use.

30 Claims, 8 Drawing Sheets

A

B

C

FOLDING INTERCHANGEABLE IMPLEMENT APPARATUS

CROSS REFERENCE TO RELATED APPLICATION

This application claims priority to a provisional application, U.S. Ser. No. 61/647,668, filed May 16, 2012, entitled Folding Interchangeable Implement Apparatus, by Richards, Todd, which is hereby incorporated by reference.

BACKGROUND OF THE INVENTION

1. Field of the Invention

The invention relates generally to compact folding multi implement tools. More specifically, it relates to an apparatus with rotating, interchangeable implements retained in a common handle by a quick release cam locking mechanism.

2. Description of the Related Art

Portable, multi-implement tools such as foldable pocketknives are well known in the prior art. In addition to a set of cutting blades, such tools commonly include other implements such as saws, files, screwdrivers, scissors, etc., that can be individually unfolded from a handle. Traditionally, the implement set was permanently joined to the tool by pins or other swiveling or pivoting type fasteners. More recently however, such tools have incorporated removable fastener mechanisms to allow the tool to be disassembled and the implements replaced or substituted with those having a different function. While many are designed to be disassembled by removing small bolts or screws, alternate mechanism have been proposed that function without the need of additional tools.

One such tool is in U.S. Pat. No. 7,926,136, issued Apr. 19, 2011 to Yale, et. al. The tool includes a pivoting holder that is described as a socket for receiving the base portion of numerous implements. The connection between the holder and the implement is maintained by a latch mechanism that may be released for replacing implements In another type of interchangeable implement tool, the bases of the implements have hooked ends for coupling with a fixed pin inside the handle portion of the device. The individual implements may be detached from the handle by positioning them in a slightly opened position and them pushing them free from the fixed pin. Such a tool is thoroughly described in U.S. Pat. App. No. 2008/0086,822 filed on Oct. 18, 2007, by Elsener.

Another interchangeable multifunction tool is described in U.S. Pat. No. 8,087,173 issued on Jan. 3, 2012 to Tang, et al. The tool includes a key and keyway type cam mechanism to sandwich one or more implement plate layers between a pair of side plates. Each implement layer comprises a segment of the cam mechanism, an implement, and a carrying plate. Different implement layers may be combined to vary the kind and number of implements housed between the side plates and the keys are designed to be manipulated by hand.

While interchangeable implement tools have the potential to tailor function more precisely than traditional fixed implement tools, the demand for fixed implement tools remains high. Despite many years of development, improved devices that make changing implements foolproof and convenient have not yet been identified. Some require careful manipulation and may be hazardous when pushing against small or sharp implement ends. Others have not been embraced because they are far too complicated to operate or require too many sophisticated parts.

Improvements in interchangeable implement tools are needed to provide updated function and convenience particularly as new implement pieces are devised. Therefore, it would be desirable to provide a foldable tool with exchangeable implements having a mechanism that is simple and easy to operate for replacing worn implements or tailoring function to a user's needs.

SUMMARY OF THE INVENTION

It is an advantage of the present invention to provide a foldable tool apparatus with implements that are safely and easily manipulated while being exchanged.

It is an advantage of the present invention to provide a foldable tool apparatus with interchangeable implements that are firmly secured by a simple quick release mechanism.

It is also an advantage of the present invention to provide a foldable tool apparatus that is tailored in function by adding, removing, or exchanging implements.

It is still another advantage of the present invention to provide an interchangeable tool apparatus having parts with standardized dimensions that may be exchanged or used with additional components to assemble multifunction tools having implements of different lengths and sizes.

These and further advantages are found in various embodiments of the inventive concept of the foldable tool as are herein shown, described, and claimed.

The present invention provides a portable, foldable tool apparatus having a set of interchangeable implements. The tool is readily assembled or disassembled for exchanging implements and other components. When assembled, the tool is held together and its implements are made secure in a handle by at least one quick release mechanism. The mechanism comprises a shaft that is hinged at one end to a cam lever and fitted at the other with a removable retainer. The shaft is an improvement over conventional implement axles found in traditional folding tools because it is easily removed from the handle. Implements of the tool comprise a base end having a void opposite the working instrument end. The shaft of the quick release mechanism is positioned through the voids so that the implements are pivotally connected to the remainder of the tool. The cam lever may be moved about its hinge between a raised and a lowered position to affect tension on the shaft. In the lowered position, the amount of tension is such that enough friction is produced on the sides of the implement bases to inhibit the implements from pivoting about the shaft. The foldable tool may comprise one or more quick release mechanisms at various places in a handle, serving to facilitate a simple and easy exchange of implements.

In an exemplary embodiment of the inventive concept, the tool comprises a quick release mechanism joined with a handle having a pair of side plates that are continuous with a back plate in between. The mechanism of the tool includes a cam lever hinged to one end of a shaft. The shaft is positioned through the handle side plates and limited in axial movement by a removable retainer at its opposite end. The shaft of the quick release mechanism is also positioned through voids of multiple implements nested between the side plates and serves as a pivot for the implements. The cam lever of the mechanism further comprises an integral cam in close proximity to the hinge. The cam profile is oriented with respect to the cam lever such that when the cam lever is in the lowered position a higher portion of the profile is in contact with a side plate, thereby increasing tension on the shaft and compressing the side plates and implements with enough force to immobilize the implements with respect to their rotation about the shaft.

When the cam lever is in the raised position, the high portion of the cam profile is moved away from the side plate and tension in the mechanism shaft is minimized. In this position, the implements may be easily rotated about the shaft for positioning, or the retainer may be removed and the shaft retracted from the handle and implements to disassemble the tool. Upon reassembly, different implements may be exchanged for those removed, or a spacer of the same dimension as one of the removed implement bases may be substituted to reduce the quantity of implements housed by the tool. With the cam lever in the lowered position, implements residing on a sufficiently tensioned shaft are immobilized in any position whether between or beyond the side plates.

The back plate portion of the handle limits the rotation of the implements about the shaft to approximately 180 degrees and provides an obstruction to implement rotation in addition to the clamping force provided by the quick release mechanism. In related embodiments, implement base dimensions are sized in multiples of a common fraction of the distance between the side plates. Further embodiments also comprise one or more tabs on the handle to maintain cam levers in alignment with the side plates. In still other related embodiments, the back plate includes a stop which inhibits the rotation of one or more implements at a position that is well before the implement has rotated 180 degrees from its nested position.

In another aspect of the inventive concept, the folding interchangeable implement tool is without a back plate and implements of the tool rotate about a relaxed shaft of a quick release mechanism in either direction for a full 360 degrees. In preferred embodiments, the shaft of the mechanism is extendable so that a range of distances may be accomplished between parallel side plates and different numbers of implements may be housed without requiring spacers or considering the dimensions of the implement bases.

In still another aspect of the inventive concept, the tool comprises twin side plate pairs, each pair having a quick release mechanism and an implement set residing on the mechanism shaft. One of the implements is a component adapted to fit together with the implement component of the other side plate pair. With the implement components fitted together in an operative position, the side plates function together as a handle for the implement.

In a further aspect of the inventive concept a tool comprises a quick release mechanism with an oversized cam lever and a set of implements among one or more side plates. To make the implements more accessible, at least one of the side plates is minimized in proportion to the implements. To adequately house the implements, the oversized lever rests in close proximity to the implements when moved to its lowered position. In one embodiment of this aspect of the inventive concept, a unitary side plate is flanked by a set of implements on both sides and penetrated by shafts of quick release mechanisms at both ends. The mechanisms both comprise oversize cam levers that when in the lowered position rest along the implements on both sides of the tool. Preferably, embodiments of this aspect of the inventive concept comprise implement sets that are without sharp or pointed damaging surfaces, or include cam levers that are sufficiently sized to significantly conceal such damaging surfaces when the implements are folded closed along the implements as the tool is carried or used.

DETAILED DESCRIPTION

Figure 1:
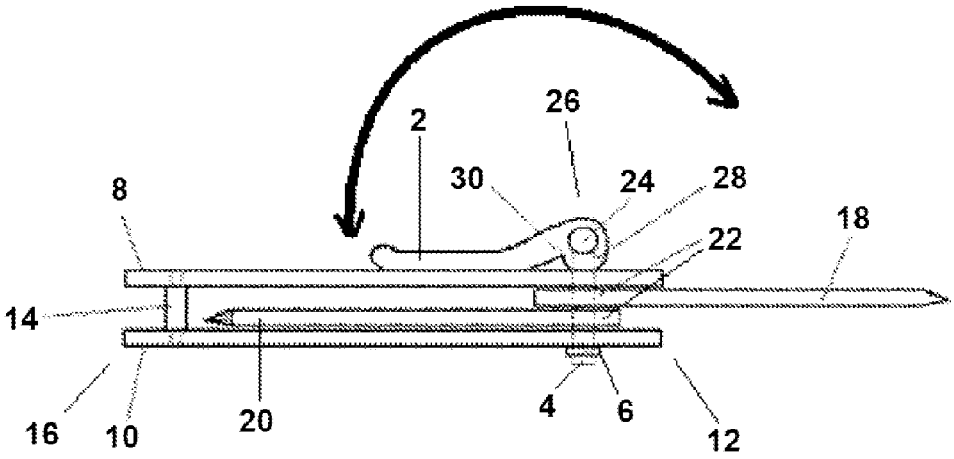
FIG. 1 is a side view of an interchangeable implement tool having a quick release mechanism.

An embodiment of an elongated folding interchangeable implement apparatus is shown in FIG. 1. The apparatus includes a handle and a set of implements that are pivotally connected and retained inside the handle by a quick release mechanism according to the inventive concept. The quick release mechanism is comprised of a cam lever 02 that is moveable between a lowered and a raised position. The cam lever 02 is hinged to one end of a substantially inelastic shaft 04 that penetrates the handle and the implement set. The shaft functions as an implement axle and is fitted at the end opposite the cam lever with a threaded retainer 06 to be tensioned when the cam lever 02 is in the lowered position as shown. When the cam lever is moved to the raised position, the implements may easily rotate about the shaft of the quick release mechanism for stowing in the handle or exposing instrument ends.

The handle of the apparatus is comprised of an upper 08 and a lower side plate 10. Voids through each side plate at a first end 12 of the handle are coaxial and adapted for commonly receiving the removable shaft 04 of the quick release mechanism. A rivet 14 having a shoulder that is approximately the same width as the implement set is used to secure the side plates at the second end 16 of the handle.

The implement set of the apparatus shown in FIG. 1 includes a knife implement 18 and a crosshead screwdriver implement 20, both having an instrument end and a flattened base end. Each of the implement base ends have substantially the same dimensions and include through voids which are aligned to be coaxial with the voids of handle side plates. The base ends 22 are sandwiched between the handle side plates and are loosely penetrated by the shaft of the quick release mechanism so as to allow the implements to rotate about the shaft 04 when the retainer is sufficiently loosened or the cam lever 02 is placed in the raised position.

The cam lever 02 of quick release mechanism includes a bifurcated end having branches that span the shaft 04 and which are hingedly connected to opposite sides of the shaft by a hinge pin 24. Together, the furcations, the pin, and the proximate end of the shaft form a hinge joint 26. Each branch, e.g., furcation of the lever further includes a cam profile 28 having a higher portion 30 positioned against the upper side plate 08 when the cam lever 02 is placed in the lowered position, i.e., adjacent and superimposed upon the upper side plate as shown in FIG. 1. The threaded retainer 06 of the quick release mechanism is positioned outside the lower side plate 10 and is greater in diameter than the side plate voids. The end of the shaft 04 opposite the hinge pin 24 is threaded and maintained in position with respect to the lower side plate 10 by the retainer as the cam lever 02 is moved from the raised to the lowered position.

The base ends 22 of the implements are pivotally connected to the shaft 04 of quick release mechanism and are in sliding contact with one another as well as with one of the side plates. Aligned with the side plates in the lowered position, the cam lever 02 functions together with the retainer 06 to tension the shaft and urge the side plates and implements together in the direction of the retainer, thereby increasing friction and inhibiting the implements from rotating about the shaft. When inhibited from being rotated or held in a particular position of rotation about the shaft, the implements are referred to herein as immobilized.

Operating the quick release mechanism is simple. To immobilize the implements, the retainer 06 should be adjusted to coordinate with the cam lever 02 to produce adequate clamping action against the implements and side plates. The clamping action may be varied from an amount that merely inhibits rotation of the implements slightly to an amount that substantially inhibits rotation. If insufficient friction is produced by a particular adjustment of the retainer, the cam lever is raised and the retainer moved closer to the hinged end of the quick release mechanism shaft. In contrast, should the position of the retainer be such that the cam lever is unable to be folded against the handle e.g., adjacent to the upper side plate 08, the retainer should be adjusted so that it is located further from the hinge end of the shaft.

As shown in FIG. 1, implements of the apparatus are substantially inhibited from rotating. An exposed instrument end of the knife implement 18 is made operable and may be utilized by grasping the handle side plates. So long as adequate friction exists, the knife implement 18 will remain static with respect to the handle rather than rotate about the shaft 04 of the quick release mechanism. After work with the knife implement is completed, the cam lever 02 is raised to release tension from the shaft 04, and the knife implement rotated to nest between the side plates, alongside the cross-head screwdriver 20. If working with the screwdriver is desired, the screwdriver is rotated to an exposed position that is suitable for the work and the cam lever 02 is again lowered to immobilize the instruments. If instead, work with the apparatus is completed, the cam lever 02 is lowered against the handle while the implement instrument ends are positioned between side plates to prevent the implements from becoming exposed while the apparatus is carried or stored.

It should be noted that as described herein the term, "raised position" includes positions of the cam lever 02 which when pivoted from the lowered position are before or after the cam lever is perpendicular to the handle so long as the high portion 30 of the cam profile 28 is pivoted off the handle side plate 08 or away from pointing in the direction of quick release mechanism shaft retainer 06.

In addition to providing clamping force for immobilizing the implements, the quick release mechanism is advantageous for substituting or renewing implements. Should it be desirable to exchange the implements shown in FIG. 1 for others compatible with the apparatus, the implements are easily freed from the handle by disassembling the quick release mechanism. With the cam lever 02 in the raised position, the retainer 06 is simply threaded loose from the shaft 04 and the shaft is withdrawn from the side plates and implements. The same type of sharpened or otherwise renewed implements may be substituted for the original knife 18 and screw driver 20 implements or a different type of implement set may be assembled to nest within the handle to provide a different functional pair. As an alternative, other implement sets may be chosen having from one to several implements, so long as the total width of the base ends in the set is approximately the same as the width of the two base ends 22 of the original implement set.

Referring now to the inventive concept in general, persons skilled in the art will recognize that the quick release mechanism and rivet shown in FIG. 1 function to limit the number of implements the handle of apparatus may retain. However, in another embodiment of the present inventive concept, handle side plates accommodate any one of numerous quick release mechanisms having various different shaft lengths and a rivet component is made removable from between the side plates to be exchanged for rivets having different shoulder widths. When longer shaft lengths and rivet shoulders are selected, more implements may be connected with the handle to provide additional function as needed.

Quick release mechanisms according to the concept of the present invention may be comprised of different types of retainers, hinge joints, and cam adjustment components so long as the mechanism incorporates a shaft that pivotally connects an implement set to a handle and releasably provides clamping force to the outside of side plates that is sufficient to immobilize implements through the action of a hinged lever. Mechanisms may be capable of providing minimal to very significant clamping force depending on the design. In some embodiments of the inventive concept, quick release mechanisms having levers in the lowered position maintain shafts under tension as implements are moved from between the handles to exposed positions as the immobilizing effect of the mechanism merely provides moderate resistance to rotation. Such mechanisms and methods of operation are particularly functional with handles providing over travel stops. In other embodiments, quick release mechanisms are substantially robust and adjusted to provide significant clamping force that substantially inhibits implements from rotating and therefore must have cam levers raised to rotate implements.

Acceptable quick release mechanism may incorporate one or more washers along their shafts, outside the side plates, for transferring clamping forces to the apparatus handle. In some embodiments, an interchangeable implement tool includes a quick release mechanism having a specialized washer located at the hinged end of the shaft outside the side plate. The specialized washer includes a cupped recess adapted to slide against a cam profile of the lever when the lever is moved about the hinge.

Retainers of interchangeable implement tools according to the inventive concept, function to maintain the position of a quick release mechanism shaft outside their neighboring side plate as the shaft is pulled from the opposite end by action of the cam lever. Shaft extending retainers providing substantial variations in shaft length are preferable in the sense that they allow for the interchange of implement sets having substantially different widths. The extending retainers may be threaded for providing adjustment at different lengths or in alternate embodiments may take the form of removable pins, clips, or the like, being fastened at multiple positions along the end of a quick release mechanism shaft adapted for receiving the retainer opposite a lever hinge joint. In preferred non-adjustable embodiments, the non-adjustable retainers are matched with handles and implement sets that together comprise pre-determined widths. In such embodiments, thicker replacement handle side plates may be used to compensate for wear or lack of adjustment in the quick release mechanism.

Figure 2:
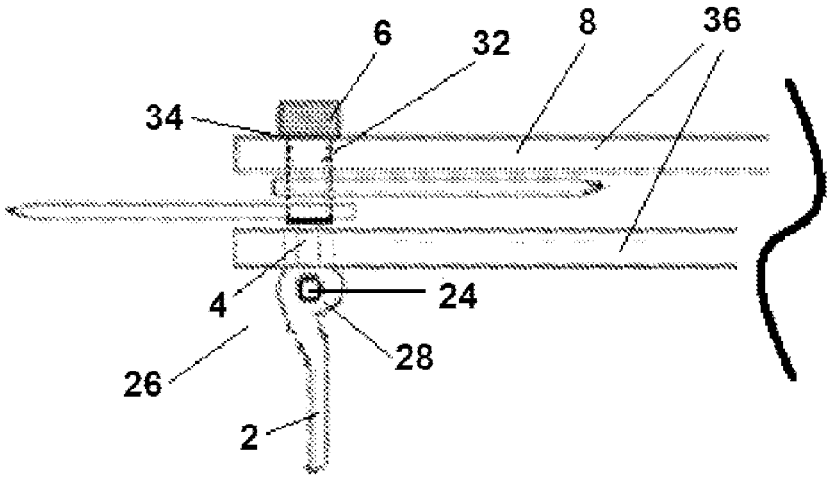
FIG. 2 is a side view of a portion of an interchangeable implement tool with a cam lever in a raised position.

In certain embodiments of interchangeable implement tools having quick release mechanisms with shaft extending retainers, retainers may be designed as elongated nuts having threads that engage the shaft over a long portion to prevent the shaft from protruding from the nut when the mechanism is made part of an apparatus with an implement set having a narrow width. In a portion of a preferred embodiment as shown in FIG. 2, an apparatus is comprised of a quick release mechanism having a threaded shaft 04 and retainer 06. The quick release mechanism is itself situated in a handle 36 having a lower and an upper side plate 08. The shaft is shown hinged at one end to a raised cam lever 02, placing no tension on the shaft. The extending retainer is threaded upon the shaft opposite the hinge joint 26 and includes a threaded tube 32 facing the hinge pin 24 that is made round and narrow to fit within side plate and implement base end voids. The threaded tube 32 of the retainer serves as the pivot upon which the implements rotate and is generally hidden by the implements and handle. Opposite the tube, an exposed portion of the retainer has a diameter greater than the voids, offering a retainer shoulder 34 to maintain the exposed portion outside the handle 36.

As the number of installed implements for the tool in FIG. 2 is changed, movement of the threaded retainer to different positions along the shaft 04 is compensated for by the void nearest the hinge joint 26, allowing more or less of the threaded tube to enter the upper side plate 08. If the set of implements is desired to be changed for one having a greater width, bushings having an outer diameter roughly the same as the narrowed portion of the retainer and an inner diameter roughly the same as the threaded portion of the shaft may be placed along the shaft within implement voids to provide stability. If instead a narrower implement set is fitted in the handle, a greater portion of the threaded tube 32 penetrates the upper side plate 08, effectively making the shaft of the mechanism extendable in length and providing variation between the cam profile 28 and the effective shoulder of the retainer 06. The extendable shaft allows the mechanism to clamp implements between side plates over a wider range of distances, expanding the possible combinations of implement sets retained by the handle.

Figure 3:
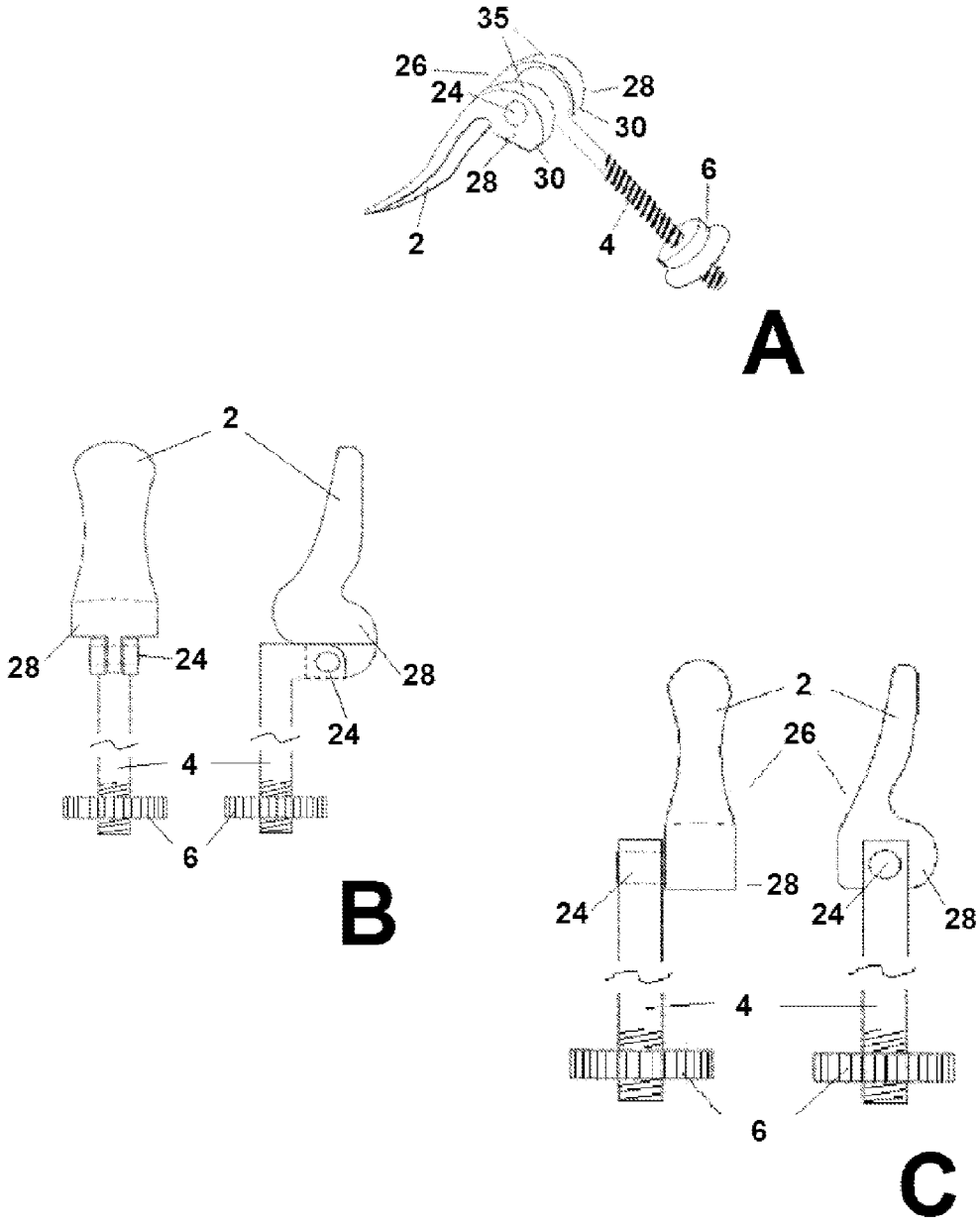
FIG. 3A is an isometric view of a quick release mechanism having a bifurcated cam lever.
FIG. 3B is an elevation view of a quick release mechanism having a bifurcated shaft which differs by 90 degrees.
FIG. 3C consists of elevation views of a quick release mechanism having a unilateral hinge pin which differs by 90 degrees.

Hinge joints of tools according to the inventive concept include a cam lever and retainer at opposite ends of a substantially inelastic shaft and function by turning a higher portion of a cam in the direction of a retainer to produce an implement immobilizing clamping force. Shown in FIG. 3 is a quick release mechanism of the inventive concept separated from an apparatus handle. The mechanism includes a hinge joint 26 having a cam lever 02 with a bifurcated end. The furcations 35 of the lever span the shaft 04 of the quick release mechanism and are connected to the same by a hinge pin 24. The lever 02 is moveable between a raised and a lowered position and incorporates a cam profile 28 in proximity to the hinge joint 26.

Preferably the amount of clamping force transferred by a hinge joint is made adjustable. For example, the hinge joint shown with the remainder of a quick release mechanism in FIG. 3A includes a cam lever that coordinates with an adjustable retainer to vary the amount of clamping force. The cam lever is pivotally connected to the shaft and includes a cam profile. The cam profile 28 is oriented such that when the lever is in the lowered position a high portion 30 of the profile would be pressed against the outside of an apparatus handle side plate. At the opposite end of the shaft, an adjustable retainer 06, in the form of a threaded thumb nut, moves throughout a range of adjustments along a threaded portion of the quick release mechanism shaft 04. If, after assembly with a compatible handle and implement set, the force produced by the mechanism is insufficient to immobilize the implements, the hinge joint is adjusted by moving the position of the retainer closer to the cam profile. The adjustment is most easily accomplished while the cam lever is raised and will result in increasing the potential tension on the shaft when the lever is again moved to the lowered position.

Other acceptable hinge joints comprise a cam lever 02 with a single cam profile 28 that pivots on an offset bifurcated shaft 04, an embodiment of which is shown with a knurled adjustable retainer 06 in multiple views in FIG. 3B. In other embodiments, a quick release mechanism shaft may be angled approximately 90 degrees near the proximity of a hinge joint 26 to form a hinge pin or, as shown in two views in FIG. 3B, may at the same location support a hinge pin 24 which protrudes unilaterally from only one side of the shaft 04 to support a pivoting lever 02. In this embodiment, the cam lever 02 pivots asymmetrically with respect to the mechanism shaft 04 to urge the cam profile 28 against the handle and provide clamping force in coordination with the retainer 06 at an opposite end of the shaft 04. Bifurcated shaft and unilateral hinge joint designs are compatible with adjustable or non-adjustable retainers to oppose the forces they produce at opposite ends of their respective quick release mechanism shafts.

Figure 4:
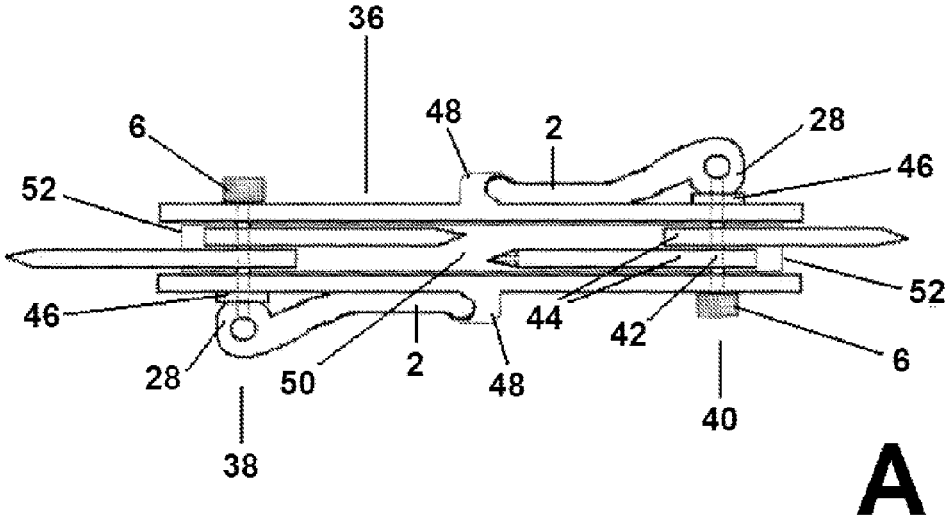
FIG. 4A is a side view of an interchangeable implement tool having a continuous back plate handle and implement sets retained by quick release mechanisms at both ends.
FIG. 4B is perspective view of the tool shown in FIG. 4.
Figure 4:
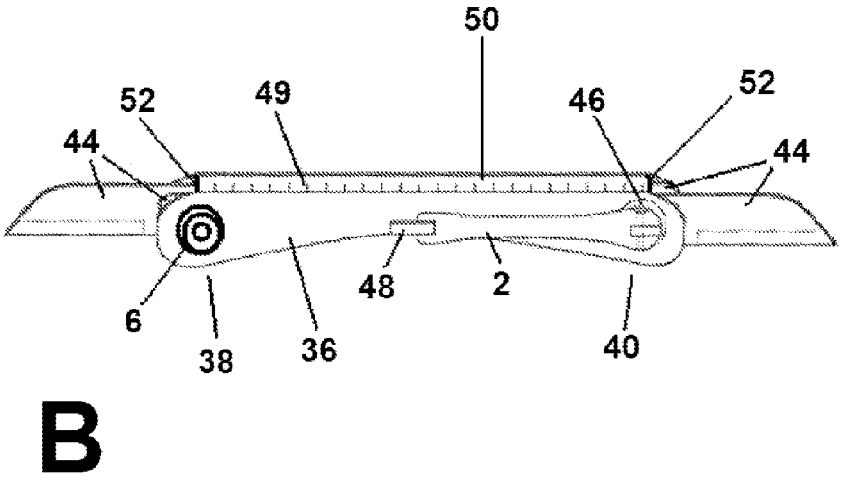

In accordance with the inventive concept, alternate views of an interchangeable implement apparatus having first and second quick release mechanism pivotally connecting a first and second implement set to opposite ends of a common handle 36 are shown in FIGS. 4A and 4B. Sides of the implement sets 44 are in sliding contact with side plates of the handle. The two mechanisms of the apparatus each include a hinge joint and are shown with cam levers 02 in their lowered positions, superjacent to the side plates and providing tension to the mechanism shafts. The handle ends each include a pair of coaxial voids sized to accommodate the quick release mechanism shafts. Implements of the implement sets have base end voids and are retained between the handle side plates by the shafts traversing through the handle and implement voids. With clamping forces from the mechanisms released, the implements freely pivot about the shafts from nested positions between the handle side plates to fully exposed and extended positions.

As shown in FIG. 4A, one implement from each set 44 is immobilized in an exposed position and another from each set is immobilized with its instrument end nested between the handle side plates.

Like the first quick release mechanism 38, the second quick release mechanism 40 includes a second quick release mechanism shaft 42 that is non-extendable. The second shaft 42 retains a second implement set on the second end of the handle. The second mechanism 40 is situated along the handle, inverted and parallel to the first quick release mechanism, at a sufficient spacing to avoid interferences between the rotating implement sets.

The quick release cam levers 02 are hinged to the shafts opposite adjustable threaded retainers 06. The cam levers include cam profiles 28 adjacent to the side plates and opposed on the shafts by the retainers 06 which are adjusted to provide sufficient tension to immobilize the implements when the cam profiles are made to urge the side plates by action of the cam levers.

The quick release mechanisms also include cupped washers 46 placed along the shafts between the cam levers and the side plates. The washers 46 have through voids that allow them the travel along the shafts, transferring force from the cam profiles 28 to each side plate.

Protruding from the side plates and contacting the cam levers opposite each hinged end is a tab 48. The tabs prevent the quick release mechanism shafts from rotating in the handle and secure the levers adjacent to and in alignment with the side plates.

Figure 5:
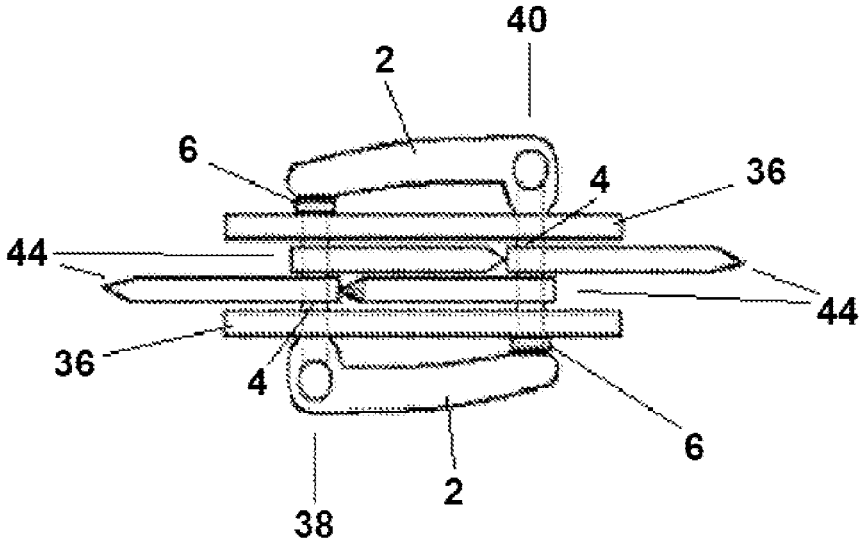
FIG. 5 is a side view of an interchangeable implement tool having two quick release mechanisms with oversized cam levers.

In still another embodiment, an interchangeable implement tool comprises a first 38 and second 40 quick release mechanism as shown in FIG. 5. The mechanisms function to retain implements between two side plates of a handle 36 and are easily removed from the remainder of the tool for exchanging implements. The mechanisms comprise adjustable retainers 06 on shafts 04 that traverse voids in the handle side plates and implements and that are hinged at opposite ends to oversized cam levers. When the cam levers 02 are placed in the lowered position as shown, the cam lever of the first mechanism 38 covers the retainer of the second mechanism 40 and the lever of the second mechanism 40 covers the retainer of the first 38. The large cam levers serve to enclose implements of the implement sets 44 stowed in the handle and provide a gripping structure such that side plates may be minimized. In related embodiments, a single side plate may be used for the purpose of joining two quick release mechanisms retaining separate implement sets, and stowed implements may also serve as part of a handle.

Referring now generally to tools of the inventive concept, cam levers may be slotted to accept handle tabs for the purpose of keeping the levers secure. Also, other components in addition to tabs may serve as tab means to keep cam levers of interchangeable implement tools of the inventive concept in alignment with the handle side plates. Such components might include magnets or channels in the handle or the like, so long as the components engage the cam levers in the lowered position and inhibit the levers from becoming misaligned. In another embodiment, two quick release mechanisms may be arranged in a handle having cam levers on the same side of the tool so that the levers mechanically interface when placed in a lowered position against the handle.

Referring again to the tool shown in FIGS. 4A and 4B, the handle is further comprised of back plate 50 continuous with the two handle side plates. The back plate 50 spans between and is perpendicular to the side plates along the full length of the handle, behind the folded implements as shown in FIG. 4A.

As shown in FIG. 4B, the back plate 50 of the apparatus extends along the length of the handle 36, significantly enclosing the implements between the side plates and providing graduations 49 on its outside surface for measuring. With the cam levers in the raised position, each of the implements easily rotates approximately 180 degrees around one of the shafts of the quick release mechanisms before contacting one of two over travel stops 52, integral with the back plate 50 and in proximity to the implement base ends of each set. While lowering the levers with the retainers properly adjusted immobilizes the instruments to some extent, maximum resistance to implement rotation is achieved by rotating an implement to be used against one of the stops.

In the embodiment of the inventive concept shown in FIGS. 4A and 4B all implements of both sets are stopped by the back plate ends. However, in other embodiments according to the inventive concept not shown, a partial back plate may be used to allow some of the implements to be more or less limited from rotating or not affected by the back plate at all. Alternatively, over travel stops may be designed to originate from a side plate rather than a back plate.

The embodiment of an apparatus shown in FIGS. 4A and 4B is fitting for severe use, since the stops 52 essentially prevent fully extended implements from rotating when subjected to forces that would otherwise cause the tool to fold. However, because of the back plate, distances between the side plates along the inside of the handle are substantially fixed. Therefore, implements of the apparatus sets may be interchanged with others, but only so long as the set widths remain substantially constant.

Implements of the sets shown in FIGS. 4A and 4B are standard sized, having base ends of a particular width. The implements are easily removed from the apparatus by removing the retainers from the quick release mechanisms and withdrawing the shafts from the handle side plates. Once the mechanisms are removed, individual implements may be exchanged but the number of standard sized implements in each set must remain the same unless spacers, capable of making sufficient friction contact with neighboring components and approximately the width of standard sized base ends are incorporated into the set. Alternatively, non-standard implements, having wider or narrower base ends may be incorporated into the sets to vary the number of implements on either side of the handle.

Figure 6:
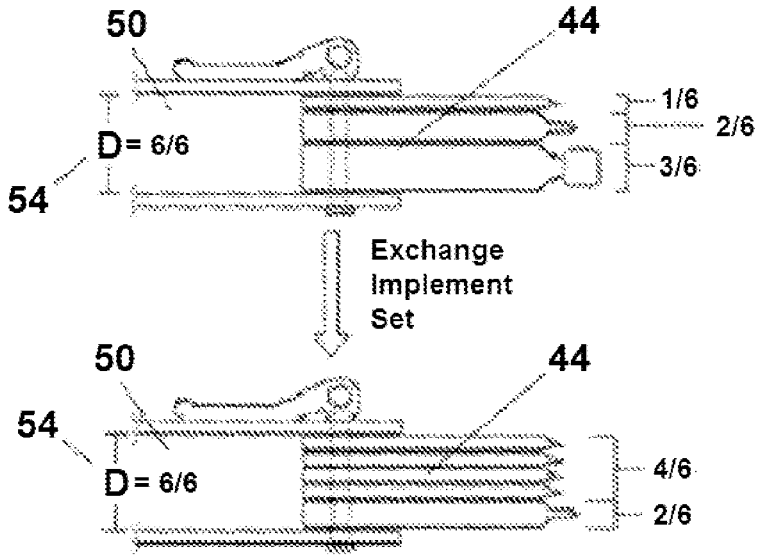
FIG. 6 is a representation of a portion of an interchangeable implement tool before and after an implement set is exchanged.

In general, embodiments having continuous back plate handles preferably also comprise sets of implements with base ends having widths that are multiples of a common fraction of the distance between side plates to maximize the combinations of implements that might be installed. Shown in FIG. 6 is one end of interchangeable implement tool apparatus having a handle with a back plate 50 and a quick release mechanism according to the inventive concept. The figure shows the tool as it appears both before and after the implement set 44 is changed. In both instances the total distance between the side plates remains substantially the same and equal to the width of the implement sets. The total side plate distance 54 before the implement change is equal to "D" and the tool comprises three implements having base ends that are $1/6$, $2/6$, and $3/6$ of D in width. After the implement set change, the side plate distance 54 remains the same and the set instead comprises four implements having base ends that are $1/6$ and another that is $2/6$ of D.

Referring again to the inventive concept more generally, tools may comprise a single or multiple quick release mechanisms retaining interchangeable implements in a single handle side plate pair. Handles with a quick release mechanism at one end may be also include a conventional implement axle and implement rotation inhibitor permanently fixed between the handle side plates to secure rotating but non-interchangeable implements at an opposite end. In interchangeable implement tools incorporating these features, fixed implement axles are particularly appropriate for mainstay implements such as knife blades, etc., since such implements are likely to be desired in the selection of implements for the tool. In addition, conventional rotation inhibiting components such as spring stops may be directly combined with exchangeable implements retained by quick release mechanism shafts for limiting rotation.

Figure 7:
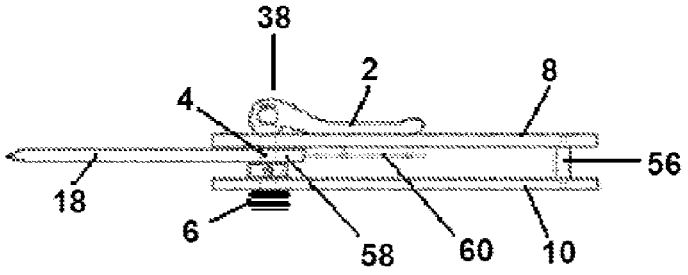
FIG. 7 is a combination of three views of an interchangeable implement tool having implements in different configurations.
Figure 7:
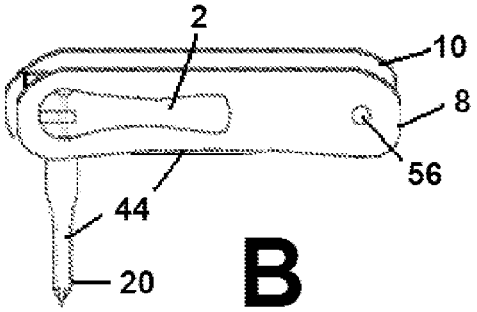
Figure 7:
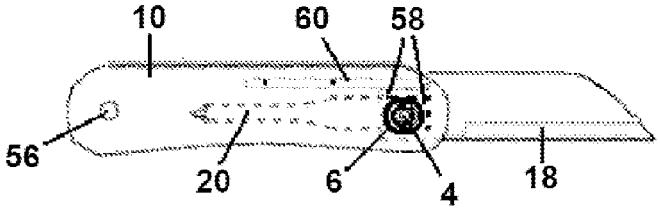

Shown in different implement configurations in FIG. 7 is an interchangeable implement tool having separate upper 08 and lower 10 handle side plates fitted with a quick release mechanism 38 at one end. The mechanism includes a cam lever 02 hinged to a shaft 04 which penetrates voids in the side plates and is fitted on the opposite end by a removable retainer 06. Along the shaft 04 and nested between the side plates is a removable implement set 44. Side plate ends opposite the quick release mechanism are fixed together by a permanent rivet 56 and only the quick release mechanism shaft serves as an implement axle for the tool.

The implement set 44 includes implements base ends 58 that are in sliding contact with one another, and instrument ends that function as a knife blade and a cross-head screwdriver. In configurations 7A and 7B the screwdriver 20 is shown in an exposed position, with its instrument end approximately 90 degrees from between the side plates. The retainer 06 (out of view in 7B) is adjusted so that the mechanism provides substantial clamping force to the side plates when the cam lever 02 is in the lowered position, immobilizing the screwdriver implement 20 in the exposed position as shown. Although not fully extended and without encountering an over travel stop, the screwdriver 20 of the tool is useful for driving screws in obstructed spaces while in this position.

With the lever moved to the raised position, the instrument end of the screwdriver may be rotated between the handle of the tool and the knife implement 18 extended. As shown by configuration 7C, the tool is viewed from the opposite side with the screwdriver implement 20 stowed, the knife implement 18 instrument end rotated to an exposed position, and the cam lever (not shown in 7C) placed in the lowered position. In configurations 7A and 7C, a stop spring 60, fixed to the upper handle side plate 08 in alignment with the knife implement 18 makes contact with the base end 58 of the knife implement to limit rotation of the implement.

In general, the mechanism of the interchangeable implement tool shown in FIG. 7 may be adjusted differently depending upon the needs of the user. The mechanism may instead be adjusted to at all times provide only minimal clamping force so that the screwdriver may be rotated between stowed and exposed positions with the cam lever 02 remaining lowered. Alternatively, the retainer may be adjusted more loosely or tightly so that the over travel stop function of the spring 60 functions with or without assistance from the clamping force of the quick release mechanism 38, to immobile the knife implement 18 for use.

Aspects of the inventive concept are applicable to complex embodiments of folding tools. Shown in FIG. 8, a compact, interchangeable implement tool comprises two handle side plate pairs. Each of the pairs includes two quick release mechanisms at opposite ends and each mechanism retains an implement set that rotates about a mechanism shaft. The implement sets rotate between the handle side plates when the mechanisms are not producing substantial clamping force. However, a back plate (not shown) that is continuous with each of the handle side plate pairs includes over travel stops 52 at each end, to limit the rotation of implements to approximately 180 degrees.

Four quick release mechanisms, each having a cam lever 02 hinged to a shaft 04 opposite a threaded retainer 06 serve as implement axles on the first ends 12 and the second ends 16 of the handle side plate pairs. Shown in the lowered position, the levers 02 are secured adjacent to each side plate by tabs 48 protruding from the side plate pairs. The levers 02 are moveable between raised and lowered positions and include integral cam profiles (not shown). When the levers are placed in the lowered position, as shown, the mechanisms function to produce clamping forces on the outside of the side plate pairs.

Within each of the implement sets retained between the first ends 12 of the side plate pairs is a single jaw 62 of a pliers. The jaws 62 are pivotally joined together at a fulcrum 64, forming a complete first class lever implement that is operable as a set of pliers when the jaws 62 are extended from their respective handle side plate pairs, as shown. The jaws 62 are limited in rotation by contact with the back plates at their base ends 22 and are further immobilized by clamping action from the quick release mechanisms. When the jaws 62 are in the extended position, the side plate pairs function together as a handle 36 for squeezing, as the jaws are urged to pivot around the fulcrum 64.

Figure 8:
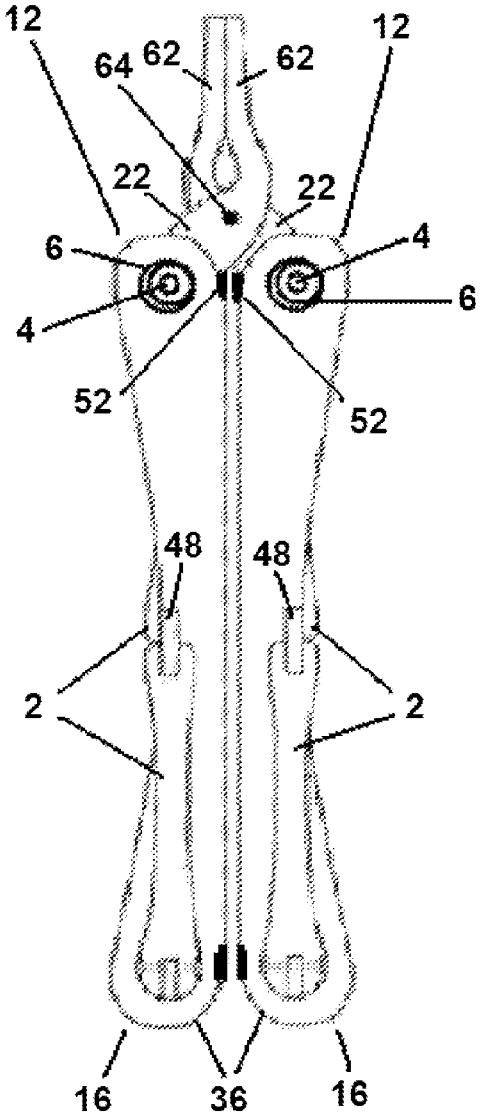
FIG. 8 is side view of an interchangeable implement tool having dual side plate pairs for operating a first class lever implement.

In alternate embodiments, one or more of the quick release mechanism shafts shown or described in FIG. 8 may be substituted by a non-removable implement axel. In other embodiments, a different first class lever implement such as a wire cutter or scissors may have components retained in separate side plate handle pairs. In further alternate embodiments, pivoting components of first class lever implements housed in separate side plate pairs may be adapted to be disjoined from the one another so that side plate pairs may be separated for storage or carry.

Specific embodiments shown or described are intended to be exemplary rather than limiting. Additional embodiments combining features and details of the disclosure herein are now made obvious to persons skilled in the art and understood to be in keeping with the spirit and scope of the inventive concept and appended claims.

I claim:

1. An interchangeable implement apparatus comprising:

a) one or more implement sets, each said implement set comprising one or more implements, each said implement having an instrument end and a base end, with the base end having a void;

b) one or more handle side plates, each said handle side plate having a void through a first end, the first end of said handle side plate being adjacent to and in sliding contact with at least one implement base end; and c) a first quick release mechanism having an elongated shaft traversing through the voids of the one or more implements of a first implement set of the one or more implement sets and through the side plate voids of the one or more handle side plates; the shaft hinged at one end to a cam lever at a hinged end of the cam lever and fitted at an opposite end with a retainer means, with the one or more implements of the first implement set and the one or more handle side plates located between the cam lever and the retainer means; the retainer means being wider than the voids for maintaining the position of the opposite end of the shaft; with the cam lever being moveable between a raised position and a lowered position and having a cam profile located proximate to the hinged end of the cam lever; the one or more implements of the first implement set being pivotally connected at their base ends about the shaft of the first quick release mechanism between the cam lever and the retainer means so as to rotate among a range of positions when the cam lever is in the raised position;

whereby in the lowered position, a higher portion of the cam profile is presented toward the retainer means end of the shaft, urging the base ends of the one or more implements of the first implement set and the one or more handle side plates together in the direction of the retainer means, for immobilizing the rotation of the one or more implements of the first implement set.

2. The apparatus of claim 1, wherein the one or more implements of the first implement set are positioned to rotate on the shaft of the quick release mechanism between two handle side plates, said two handle side plates being oriented substantially parallel to each other and comprising a handle for the apparatus.

3. The apparatus of claim 2, wherein the shaft of the first quick release mechanism is extendable to provide a range of distances between the two handle side plates in order to accommodate differing numbers of implements therebetween.

4. The apparatus of claim 3, further comprising a stop means on the handle to contact the base end of at least one implement, thereby limiting the range of rotation for said implement.

5. The apparatus of claim 3, further comprising a) two or more implement sets;

b) a second implement set of the two or more implement sets, said second implement set being different than the first implement set;

c) each of the two said handle side plates having a second void through a second end opposite the first end, said second end of said handle side plate being adjacent to and in sliding contact with at least one base end of an implement of the second implement set; and d) a second quick release mechanism having an elongated shaft traversing through the voids of the one or more implements of the second implement set and through the second voids of the one or more handle side plates; the shaft of the second quick release mechanism hinged at one end to a second cam lever at a hinged end of the second cam lever and fitted at an opposite end with a second retainer means, with the one or more implements of the second implement set and the one or more handle side plates located between the second cam lever and the second retainer means; the second retainer means being wider than the second voids for maintaining the position of the opposite end of the shaft of the second quick release mechanism; with the second cam lever being moveable between a raised position and a lowered position and having a cam profile located proximate to the hinged end of the second cam lever; the one or more implements of the second implement set being pivotally connected at their base ends about the shaft of the second quick release mechanism between the second cam lever and the second retainer means so as to rotate among a range of positions when the second cam lever is in the raised position;

whereby in the lowered position, a higher portion of the cam profile of the second cam lever is presented toward the second retainer means end of the shaft of the second quick release mechanism, urging the base ends of the one or more implements of the second implement set and the one or more handle side plates together in the direction of the second retainer means, for immobilizing the rotation of the one or more implements of the second implement set, with the shaft of the second quick release mechanism oriented substantially parallel to the shaft of the first quick release mechanism and located a sufficient spacing from the shaft of the first quick release mechanism such that the one or more implements of the second implement set avoid interfering with rotation of the one or more implements of the first implement set.

6. The apparatus of claim 5, further comprising a back plate in connection with and continuous with the two handle side plates and being oriented substantially perpendicular to each handle side plate.

7. The apparatus of claim 5, further comprising a) a back plate in connection with and continuous with the two handle side plates and being oriented substantially perpendicular to each handle side plate;

b) a first stop means on the handle located proximate to the shaft of the first quick release mechanism to contact the base end of at least one implement of the first implement set, thereby limiting the range of rotation for said implement; and c) a second stop means on the handle located proximate to the shaft of the second quick release mechanism to contact the base end of at least one implement of the second implement set, thereby limiting the range of rotation for said implement.

8. The apparatus of claim 5, wherein the second retainer means of the second quick release mechanism is threadedly engaged with the shaft of the second quick release mechanism.

9. The apparatus of claim 8, further including a) a first cam washer located between the cam profile of the cam lever of the first quick release mechanism and one of the two handle side plates, said first cam washer located along the shaft of the first quick release mechanism, said first cam washer transferring force from the cam lever of the first quick release mechanism to the handle when the cam lever of the first quick release mechanism is placed in the lowered position; and b) a second cam washer located between the cam profile of the cam lever of the second quick release mechanism and said handle side plate, said second cam washer located along the shaft of the second quick release mechanism, said second cam washer transferring force from the cam lever of the second quick release mechanism to the handle when the cam lever of the second quick release mechanism is placed in the lowered position.

10. The apparatus of claim 5, further comprising at least one tab means located on the handle; the tab means engaging with the second cam lever of the second quick release mechanism for securing alignment of the second cam lever of the second quick release mechanism with one of the two handle side plates.

11. The apparatus of claim 10, further including a) a first cam washer located between the cam profile of the cam lever of the first quick release mechanism and one of the two handle side plates, said first cam washer located along the shaft of the first quick release mechanism, said first cam washer transferring force from the cam lever of the first quick release mechanism to the handle when the cam lever of the first quick release mechanism is placed in the lowered position; and b) a second cam washer located between the cam profile of the cam lever of the second quick release mechanism and said handle side plate, said second cam washer located along the shaft of the second quick release mechanism, said second cam washer transferring force from the cam lever of the second quick release mechanism to the handle when the cam lever of the second quick release mechanism is placed in the lowered position.

12. The apparatus of claim 3, wherein the base ends of the one or more implements of the first implement set each has a width that is approximately sized as a multiple of a common fraction of a distance between the two handle side plates when the cam lever of the first quick release mechanism is in the lowered position, for interchanging the first implement set with another implement set having the same or a different number of implements.

13. The apparatus of claim 2, further comprising a back plate in connection with and continuous with the two handle side plates and being oriented substantially perpendicular to each handle side plate.

14. The apparatus of claim 13, further comprising a stop means on the handle to contact the base end of at least one implement, thereby limiting the range of rotation for said implement.

15. The apparatus of claim 13, further comprising graduations along the handle, said graduations suitable for use for measuring.

16. The apparatus of claim 13, wherein the base ends of the one or more implements of the first implement set each has a width that is approximately sized as a multiple of a common fraction of a distance between the two handle side plates when the cam lever of the first quick release mechanism is in the lowered position, for interchanging the first implement set with another implement set having the same or a different number of implements.

17. The apparatus of claim 2, wherein the retainer means of the first quick release mechanism is threadedly engaged with the shaft of the first quick release mechanism.

18. The apparatus of claim 17, further including a cam washer located between the cam profile of the cam lever of the first quick release mechanism and one of the two handle side plates, said cam washer located along the shaft of the first quick release mechanism, said cam washer transferring force from the cam lever of the first quick release mechanism to the handle when the cam lever of the first quick release mechanism is placed in the lowered position.

19. The apparatus of claim 2, further comprising at least one tab means located on the handle; the tab means engaging with the cam lever of the first quick release mechanism for securing alignment of the cam lever of the first quick release mechanism with one of the two handle side plates.

20. The apparatus of claim 19, further including a cam washer located between the cam profile of the cam lever of the first quick release mechanism and one of the two handle side plates, said cam washer located along the shaft of the first quick release mechanism, said cam washer transferring force from the cam lever of the first quick release mechanism to the handle when the cam lever of the first quick release mechanism is placed in the lowered position.

21. An interchangeable implement apparatus comprising:

a) an implement set having one or more implements, said one or more implements each having a base end and an instrument end, each said base end including a through void;

b) a first handle side plate and a second handle side plate, said first and second handle side plates forming a handle, said first and second handle side plates being elongated and each having a void through a first end, the handle side plates located substantially parallel to each other along each side of the implement set, with the base end voids of the one or more implements and handle side plate voids coaxially aligned; and c) a first quick release mechanism having an elongated shaft traversing through the base end voids of the one or more implements and the handle side plate voids; the shaft hinged at one end to a cam lever forming a hinge joint and fitted at an opposite end with a retainer means for maintaining the opposite end of the shaft in place;

with the cam lever being moveable between a raised and a lowered position and having a cam profile located proximate to the hinge joint, whereby in the raised position the one or more implements rotate about the shaft of the first quick release mechanism among a range of positions, and whereby in the lowered position a higher portion of the cam profile is positioned against the handle while being opposed at the opposite end of the shaft by the retainer, thereby urging the side plates and the base ends of the one or more implements together for immobilizing the rotation of said implements.

22. The interchangeable implement apparatus of claim 21, further comprising a back plate having a stop that contacts at least one of the one or more implements for limiting rotation.

23. The interchangeable implement apparatus of claim 22, further comprising a second quick release mechanism and a second voided implement set; voids through the second implement set being coaxial with through voids of the side handle plates at second ends opposite the first ends of the handle side plates, the second quick release mechanism including a cam lever, cam hinge joint, shaft, and retainer, each corresponding in structure with the cam lever, cam hinge joint, shaft, and retainer, respectively, of the first quick release mechanism, said second quick release mechanism assembled in the handle to immobilize the second implement set when the cam lever of the second quick release mechanism is in the lowered position.

24. The interchangeable implement apparatus of claim 23, further comprising a tab protruding from the handle to engage at least one of the cam levers opposite its respective cam hinge joint for maintaining alignment of said cam lever with the handle.

25. The interchangeable implement apparatus of claim 24, wherein each of the retainers is removably threaded onto the respective shaft.

26. An interchangeable implement apparatus comprising:

a) a first handle side plate pair and a second handle side plate pair, each of the handle side plate pairs having a first side plate and a second side plate;

b) a first implement set having one or more implements, each said implement having an instrument end and a base end, the first implement set comprising a first component of a first class lever implement pivotally attached to the first handle side plate pair by a first implement axle, said first implement axle allowing the first implement set to rotate between the first side plate and the second side late of the first handle side plate pair; and c) a second implement set having one or more implements, each said implement having an instrument end and a base end, the second implement set comprising a second component of a first class lever implement pivotally attached to the second handle side plate pair by a second implement axle, said second axle allowing the second implement set to rotate between the first side plate and the second side plate of the second handle side plate pair;

wherein the first component of a first class lever implement and the second component of a first class lever implement are pivotally joined with one another forming an operable first class lever implement when rotated from the first and second handle side plates, respectively, and wherein at least one of the first or second implement axles is a quick release mechanism having an elongated shaft penetrating the first and second side plate of one of the first or second handle side plate pairs; said quick release mechanism shaft being hinged at one end to a cam lever and fitted at an opposite end with a retainer for maintaining the opposite end of the shaft in place while the quick release mechanism provides a clamping force to immobilize one of the first class lever components.

27. The apparatus of claim 26, further comprising a back plate continuous with at least one of the first or second handle side plate pairs.

28. The apparatus of claim 27, further comprising a stop for limiting the rotation of at least one of the first class lever components.

29. The apparatus of claim 28, wherein the components of the first class lever implement are disjoinable for stowing separately within their respective side plate pairs.

30. The apparatus of claim 26, wherein the first implement set comprises two or more implements, of which only one is the first component of a first class lever implement; and the second implement set comprises two or more implements, of which only one is the second component of a first class lever implement.

* * * * *